United States Patent [19]
Leitermann
[11] 4,258,679
[45] Mar. 31, 1981

[54] DEVICE FOR CONTROLLING THE LUBRICATING OIL TEMPERATURE OF A COMBUSTION ENGINE HAVING AN OIL CONTAINER

[75] Inventor: Wulf Leitermann, Bad Wimpfen, Fed. Rep. of Germany

[73] Assignee: Audi NSU Auto Union Aktiengesellschaft, Neckarsuim, Fed. Rep. of Germany

[21] Appl. No.: 31,161

[22] Filed: Apr. 18, 1979

[30] Foreign Application Priority Data

Apr. 22, 1978 [DE] Fed. Rep. of Germany ..... 2817743

[51] Int. Cl.[3] ..... F01M 5/00
[52] U.S. Cl. ..... 123/196 AB; 184/104 A
[58] Field of Search ..... 123/196 R, 196 AB, 195 C; 184/1.5, 6.5, 104 A, 106

[56] References Cited

U.S. PATENT DOCUMENTS

| | | | |
|---|---|---|---|
| 1,351,716 | 8/1920 | Cochrane | 123/196 AB X |
| 1,976,772 | 10/1934 | Clarke | 123/196 AB |
| 2,122,585 | 7/1938 | Pollack et al. | 123/196 AB X |
| 4,134,380 | 1/1979 | Niwa et al. | 123/196 R X |
| 4,150,655 | 4/1979 | Gaggiano et al. | 123/196 AB |

*Primary Examiner*—Tony M. Argenbright
*Attorney, Agent, or Firm*—Charles R. Hoffmann

[57] ABSTRACT

A device for controlling the lubricating oil temperature of a combustion engine having an oil container for the oil supply of the lubricating oil cycle of the combustion engine and an oil catch basin provided for receiving the return flow of the oil. The catch basin has a smaller volume than the oil container and communicates with the oil container by means of a thermostatically controlled valve. An oil pump communicates with the oil container and/or with the oil catch basin depending upon the position of the valve. A suction device is located at an intermediate chamber at the lowest point of the oil catch basin and communicates with the oil catch basin at low temperature by means of the thermostatically controlled valve positioned in the intermediate chamber and communicates with the oil container during operating temperature. The oil catch basin communicates with the oil container by at least one overflow opening and the oil catch basin communicates with the oil container by means of a float valve provided in the oil catch basin and which opens when the oil supply drops off.

5 Claims, 3 Drawing Figures

DEVICE FOR CONTROLLING THE LUBRICATING OIL TEMPERATURE OF A COMBUSTION ENGINE HAVING AN OIL CONTAINER

BACKGROUND OF THE INVENTION

The invention relates to a device for controlling the lubricating oil temperature of a combustion engine having an oil container for the oil supply of the lubricating oil cycle of the combustion engine and an oil catch basin provided for receiving the return flow of the oil. The catch basin has a smaller volume than the oil container and communicates with the oil container by means of a thermostatically controlled valve. An oil pump communicates with the oil container and/or with the oil catch basin depending on the position of the valve.

In this type of device, known from German Laid Open Patent No. 25 11 451, for example, a partial quantity of the lubricating oil which is discharged from the piston of the combustion engine is heated in the hot zone of the combustion engine housing and is fed to the lubricating oil cycle. This is in order to obtain a rapid heating of the combustion engine after a cold start which is favorable with respect to the fuel consumption and the cold wear. In this embodiment, the other portion of the lubricating oil is admixed to the oil which is discharged by the piston, so as to obtain an even temperature level. However, it had been shown that, after reaching the operating temperature of the combustion engine, the heated lubricating oil which flows from the oil catch basin to the oil container may be immediately suctioned off into the lubricating oil cycle. This is due to the arrangement of the thermostatically controlled valve in the proximity of the suction point of the oil pump as well as in the proximity of the connection between the oil container and the oil catch basin without a prior sufficient admixing with the remainder of the cooler oil supply, and without causing the lubricating oil temperature to increase abnormally high.

SUMMARY OF THE INVENTION

It is therefore an object of the subject invention to eliminate the aforementioned disadvantages and to provide a device for controlling the lubricating oil temperature which permits a rapid heating of the lubricating oil, but prevents an overheating of the lubricating oil.

Due to the suggested removal and feeding of the lubricating oil through the intermediary chamber which is coupled either with the oil container and/or the oil catch basin depending on the lubricating oil temperature, the given oil quantity participates completely in the lubricating oil cycle. Therefore, on the one hand, the desired rapid heating can be obtained, and on the other hand, an overheating of the lubricating oil is prevented. For example, at a low lubricating oil temperature and drastically lowered oil level in the oil catch basin additional oil may be fed from the oil container into the oil catch basin by means of the float valve, so that an overheating of the small remaining oil quantity is prevented. When the lubricating oil temperature increases the valve which is controlled by a thermostat progressively exposes the opening from the intermediary chamber to the oil container and progressively closes the opening to the oil catch basin, no that the cooler oil in the oil container can be additionally suctioned off.

Since the oil quantity which flows from the combustion engine back into the oil catch basin increases due to the added oil from the oil container, the excess oil quantity may flow into the oil container through the overflow openings. In any case, the oil which flows back from the combustion engine can admix with the oil supply present in the oil catch basin or in the oil container, before it is again suctioned off through the corresponding valve and the intermediary chamber.

The valve which couples the intermediary chamber with the oil container may be positioned at a point at the bottom of the intermediary chamber and the valve which couples the intermediary chamber with the oil catch basin may be located opposite and above this point at the top of the intermediary chamber. With such an arrangement, the valve at the bottom of the intermediary chamber may remove the oil supply in the lower portion from the oil container which is cooler and the upper valve may remove the hotter oil which is contained in the oil catch basin for the lubricating oil cycle, depending on the desired operating condition.

In order to simplify the assembly of the device the oil catch basin may be provided with an annular flange when an oil container is used which is mounted to the combustion engine by means of an annular flange, whereby these two flanges are flush with respect to each other. Therefore, the screw coupling commonly penetrates the flange of the oil container and the oil catch basin.

For obtaining a more rapid heating of the oil catch basin which is immersed in the oil supply, it is at least partially surrounded by a heating means formed by a jacket through which the exhaust gas flows. For simplified and more complete drain, the oil container and the oil catch basin are provided with flush oil drain openings which are closeable with a common oil drain screw.

One embodiment of the invention as well as further details and features are described in more detail in the following description in conjunction with the appended drawings.

DETAILED DESCRIPTION

Figure 1:
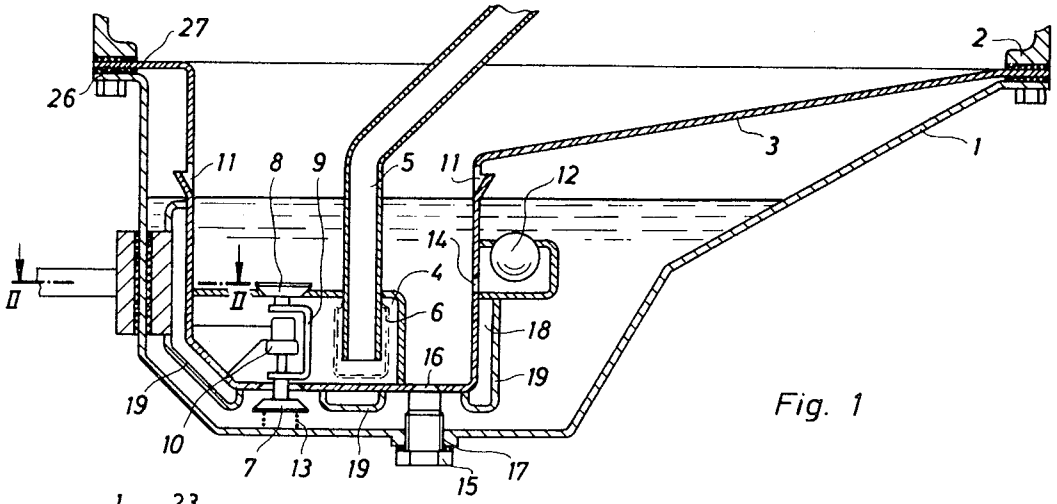
FIG. 1 shows a longitudinal section view through an oil container with an inventive device for controlling the lubricating oil temperature.

The oil container 1 shown in sectional view in FIG. 1 is mounted on the lower side of a combustion engine, whereby the combustion engine is merely indicated in shape of an annular flange 2 for mounting oil container 1. An oil catch basin 3 is mounted in oil container 1 which contains the oil supply for the lubricating oil cycle for lubricating the movable parts of the combustion engine. The oil catch basin is immersed in the oil supply and all of the oil which is discharged from the combustion engine flows back into the oil catch basin. The oil catch basin 3, which has a smaller volume for receiving the oil than oil container 1, is coupled with screws by means of a flange 27 and with a flange 26 of the oil container 1 on the annular flange 2 of the combustion engine.

An intermediary chamber 4 is provided in the oil catch basin 3 and is positioned below the oil level of the oil supply in the oil catch basin 3. The suction pipe 5 of an oil pump (not shown) extends from chamber 4. At its inlet opening the suction pipe is provided with a filter 6. The intermediary chamber 4 may be coupled to the oil supply of oil container 1 by means of a valve 7 which is mounted below intermediary chamber 4, and with the oil catch basin 3 by means of a valve 8 which is mounted above intermediary chamber 4. Valves 7 and 8 are coupled with each other by means of a yoke 9 and are commonly actuated over this yoke by a thermostat 10 which is located in the flowing oil within intermediary chamber 4. The oil catch basin 3 is coupled with the oil container 1 by means of overflow openings 11, as well as by means of a float valve 12.

When the combustion engine is in its cold operating stage and the oil temperature is low, the valve 8 is opened by thermostat 10 opposite to the shown position and valve 7 is closed. This position is supported by a spring 13 located between the base of the oil container 1 and valve 7. This means, the low quantity of oil which is present in the oil catch basin 3 after a cold start is suctioned off by suction pipe 5 through valve 8 and the intermediary chamber 4 and is fed to the lubricating points of the combustion engine. The removal of the oil from the intermediary chamber 4 assures that the return flow of the oil is not directly suctioned off but admixes with the present oil before it is again fed into the cycle. Due to the small oil quantity a rapid heating of the oil takes place and thereby a rapid heating of the combustion engine after a cold start. When the oil level drastically drops off in the oil catch basin 3 with respect to the oil level of the oil container 1 oil may be fed from the oil supply of the oil container 1 into the oil catch basin 3 by means of the also dropping float valve 12 and through opening 14 between the float valve 12 and the oil catch basin 3. However, when the oil level increases in oil catch basin 3 due to changing rotational speed of the combustion engine and the corresponding fluctuations in the quantity of the return flow of the oil the excess quantity of the oil can flow back into the oil container 1 through overflow openings 11, thereby removing this oil quantity from the lubricating oil cycle in this operating condition of the combustion engine. Due to the arrangement of the float valve 12 and the overflow openings 11 a small oil quantity is always present for a rapid heating, which cannot be overheated due to the forced path through intermediary chamber 4.

With increasing heating of the oil and the resulting heating of thermostat 10 the valve 7 at the lower side of oil catch basin container 3 is progressively opened and valve 8 is progressively closed. Thereby, cooler oil from the oil container 1 is progressively admixed to the oil which is suctioned off from the oil catch basin 3 and the intermediary chamber 4, respectively, so that the oil quantity is increased and prevents an overheating of the oil in the lubricant oil cycle despite increasing heating of the combustion engine. The increasing oil quantity which flows back into the oil catch basin 3 flows into oil container 1 through overflow openings 11.

As shown in the drawings, after reaching the operating temperature the valve 7 is completely opened by thermostat 10 and valve 8 is closed. In this position the oil is completely suctioned off from oil container 1 by suction pipe 5 through intermediary chamber 4 and valve 7, whereby the total oil supply takes part in the lubricant oil cycle. Due to the forced path of the oil which flows back into the oil catch basin and into oil container 1 through overflow openings 11, a good admixture is obtained before it is again suctioned off. An oil drain screw 15 is provided for draining the total oil supply which closes a common oil drain opening 16 in oil catch basin 3 and an oil drain opening 17 which is flush with drain opening 16.

Figure 2:
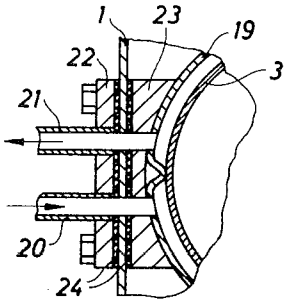
FIG. 2 shows the partial piece of a section along line II—II of FIG. 1.
Figure 3:
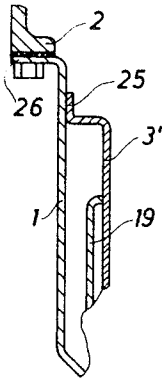
FIG. 3 shows the partial piece of a longitudinal view similar to FIG. 1, in a different embodiment.

As shown in FIG. 2, an even quicker heating may be obtained for the oil supply, in particular the oil supply in oil catch basin 3 if the area of the oil catch basin 3 which immerses into the oil supply of oil container 1 and which is substantially positioned below the oil level is encompassed by a heating device 18. The heating device 18 which is formed by a jacket 19, in this embodiment, may be supplied by exhaust gas at least in the start and warm up phase of the combustion engine. The exhaust gas is controlled by a control means (not shown). For this purpose, an exhaust gas supply line 20 and an exhaust gas discharge line 21 are provided which is guided through the outer wall of the oil container 1. The supply line 20 and the discharge line 21 are mounted on oil container 1 and on jacket 19 by means of a flange 23. Packings 24 are inserted between flanges 22 and 23 and the wall of oil container 1. Deviating from the depicted embodiment, the heating device may be supplied by a different medium. Furthermore, it is possible that the heating device consist of electrical heating elements. As can be seen from FIG. 3, the oil catch basin 3' is inserted into the oil container 1 and not commonly mounted with screws on mounting flange 2 of the combustion engine, in contrast to the embodiment shown in FIG. 1. In this case the oil catch basin 3' may engage the oil container 1 in friction fit engagement, or can be additionally rigidly mounted to oil container 1 at a face 25 by means of welding or soldering.

Thus the several aforenoted objects and advantages are most effectively attained. Although several somewhat preferred embodiments have been disclosed and described in detail herein, it should be understood that this invention is in no sense limited thereby and its scope is to be determined by that of the appended claims.

I claim:

1. A device for controlling the lubricating oil temperature of a combustion engine having an oil container for the oil supply of the lubricating oil cycle of the combustion engine and an oil pump, suction means and return means for directing the oil from the container through the combustion engine and returning the oil to the container in the lubricating oil cycle, comprising; means for mounting the device in the oil container on the combustion engine, an oil catch basin mounted in communication for receiving the return flow of the oil from the return means and the catch basin having a smaller volume than the oil container, a thermostatically controlled valve on the catch basin and providing communication between the catch basin and the oil container, the catch basin adapted to be connected to the suction means and the oil pump of the combustion engine and the thermostatically controlled valve positioned so that the suction means communicates with the oil container and/or the oil catch basin depending on the position of the thermostatically controlled valve, surfaces on the interior of the catch basin forming an intermediary chamber at the lowest point of the oil catch basin and adapted to communicate with the suction means of the combustion engine, the thermostatically controlled valve being positioned in the intermediate chamber and shiftable to provide communication between the suction means and the oil catch basin at low temperature and communication between the suction means and the oil container during operating temperature, at least one overflow opening in the oil catch basin for communication between the oil catch basin and the oil container, a float valve in the oil catch basin for communication between the oil catch basin and the oil container which opens when the oil supply drops off to provide communication between the oil catch basin and the oil container.

2. The invention in accordance with claim 1 wherein the thermostatically controlled valve is mounted in the intermediary chamber so that communication between the intermediary chamber and the oil container is provided through the thermostatically controlled valve at a point along the bottom of the intermediary chamber and communication between the intermediary chamber and the associated catch basin through the thermostatically controlled valve is provided along the top of the intermediary chamber opposite the communication point between the intermediary chamber and the oil container along the bottom of the intermediary chamber.

3. The invention in accordance with claim 1 wherein the oil container is mounted on the combustion engine by means of an annular flange, and the oil catch basin is provided with an annular flange adapted to be positioned to flush with the flange of the oil container when mounted on the combustion engine.

4. The invention in accordance with claim 1 wherein the portion of the oil catch basin which is immersed in the oil supply is at least partially surrounded by a heating means formed by a jacket adapted to be connected to the combustion engine so that the exhaust gas of the engine will flow through the jacket.

5. The invention in accordance with claim 1 wherein the oil catch basin is provided with a flush oil drain opening adapted to be aligned with a flush oil drain opening on the oil container so that both flush oil drain openings are closeable by means of a common oil drain screw.

* * * * *